US009193570B2

(12) United States Patent
Norpoth

(10) Patent No.: US 9,193,570 B2
(45) Date of Patent: Nov. 24, 2015

(54) EYEBOLT

(71) Applicant: Thiele GmbH & Co. KG, Iserlohn (DE)

(72) Inventor: Bernhard Norpoth, Essen (DE)

(73) Assignee: THIELE GMBH & CO.KG, Iserlohn (DE)

( * ) Notice: Subject to any disclaimer, the term of this patent is extended or adjusted under 35 U.S.C. 154(b) by 0 days.

(21) Appl. No.: 14/383,015

(22) PCT Filed: Feb. 26, 2013

(86) PCT No.: PCT/DE2013/100075
§ 371 (c)(1),
(2) Date: Sep. 4, 2014

(87) PCT Pub. No.: WO2013/131513
PCT Pub. Date: Sep. 12, 2013

(65) Prior Publication Data

US 2015/0028614 A1 Jan. 29, 2015

(30) Foreign Application Priority Data

Mar. 5, 2012 (DE) ..... 20 2012 100 764 U

(51) Int. Cl.
*B66C 1/66* (2006.01)

(52) U.S. Cl.
CPC ..... *B66C 1/66* (2013.01)

(58) Field of Classification Search
CPC ..... B66C 1/66; B66C 1/666; F16G 15/08; Y10T 403/32975; Y10T 403/32983
USPC ..... 294/215; 403/78, 164, 165
See application file for complete search history.

(56) References Cited

U.S. PATENT DOCUMENTS

| | | | | |
|---|---|---|---|---|
| 1,642,958 | A | 9/1927 | Joyner | |
| 2,633,375 | A | 3/1953 | Wilcoxon | |
| 2,651,533 | A | 9/1953 | Miller | |
| 5,607,248 | A | 3/1997 | Hasse | |
| 5,690,457 | A | 11/1997 | Smetz | |
| 6,039,500 | A * | 3/2000 | Kwon | 403/78 |
| 6,994,501 | B2 * | 2/2006 | Smetz | 411/400 |
| 2005/0017522 | A1 * | 1/2005 | Smetz | 294/1.1 |

FOREIGN PATENT DOCUMENTS

| | | |
|---|---|---|
| DE | 84 14 736 | 8/1984 |
| DE | 44 03 785 | 8/1995 |
| DE | 201 21 118 | 6/2002 |
| FR | 2 414 662 | 8/1979 |
| GB | 357836 | 10/1931 |

OTHER PUBLICATIONS

International Search Report issued by the European Patent Office in International Application PCT/DE2013/100075 on May 17, 2013.

* cited by examiner

*Primary Examiner* — Dean Kramer
(74) *Attorney, Agent, or Firm* — Henry M. Feiereisen LLC.

(57) ABSTRACT

An eyebolt for releasably connecting a carrying, lashing or traction member with an object includes a threaded bolt and an eyelet. The threaded bolt has an inner bearing part and the eyelet is connected to an outer bearing part which with the incorporation of rolling elements is supported on the inner bearing part. The rolling elements are disposed above one another in a ring around the inner bearing part in at least two planes extending spaced apart and parallel to one another. Rolling elements disposed in a first plane have a radius and rolling elements disposed in a second plane have a radius. The sum of the radius of one of the rolling elements disposed in the first plane and the radius of one of the rolling elements disposed in the second plane is greater than the spacing between the planes extending parallel to one another.

16 Claims, 4 Drawing Sheets

EYEBOLT

CROSS-REFERENCES TO RELATED APPLICATIONS

This application is the U.S. National Stage of International Application No. PCT/DE2013/100075, filed Feb. 26, 2013, which designated the United States and has been published as International Publication No. WO 2013/131513 and which claims the priority of German Patent Application, Serial No. 20 2012 100 769.9, filed Mar. 5, 2012, pursuant to 35 U.S.C. 119(a)-(d).

BACKGROUND OF THE INVENTION

The invention relates to an eyebolt for releasable connection of a carrying, lashing or traction member to an object.

Eyebolts serve to easily and at least temporarily connect an object to a carrying, lashing or traction member. As a result, they form a stop member which can be affixed or is already affixed to the respective object as a releasable anchor point.

The eyebolt, also known as a ring bolt, gets its name because it has an annular eyelet in place of an ordinary screw head. The carrying, lashing or traction member oftentimes involves cables or wires as well as belts or chains, which are either guided through the eyelet on the eyebolt or, for example, affixed using a shackle.

Aside from simple arrangements that provide a one-piece connection of the eyelet with an externally threaded bolt, eyelets are also known that are rotatably mounted on the bolt. The purpose of a rotatable implementation is to also allow the position of the eyelet to be aligned relative to the object, when assuming the fixed state. Through the independence gained relative to the otherwise unchangeable position of the threadably engaged eyebolt, the eyelet can be best suited to the course of the carrying, lashing or traction member.

An eyebolt that includes a threaded bolt on which an eyelet is rotatably fastened is disclosed in DE 201 21 118 U1. The threaded bolt has an inner bearing part, whereas the eyelet is connected to a corresponding outer bearing part. The outer bearing part is supported on the inner part through interposition of rolling bodies. The rolling bodies in turn are arranged behind one another about the inner bearing part so as to run in rings on at least two spaced-apart parallel planes above one another.

The eyelet, which is also swingably arranged on the outer bearing part is hereby arranged above the inner bearing part so that a pulling force perpendicular to the threaded bolt produces a respectively great moment between the inner bearing part and the outer bearing part. By the ring-shaped arrangement of the rolling bodies on spaced-apart planes, a respectively great inner leverage is made possible there between so as to reduce the stress transmitted by the moment load via the rolling bodies. At the same time, as there is little tendency to tilt, the outer bearing part can be rotatably secured with substantially no clearance to the threaded bolt that has the inner bearing part.

The disclosed construction results in a durable as well as flexible possibility for the design of such an eyebolt. However, the design results in a great structural height of the outer bearing part, causing problems especially when tight spaces are involved. Moreover, the outer bearing part exhibits a high degree of freedom in terms of its rotation about the inner bearing part, causing an undesirable twisting between the carrying, lashing or traction member and the object connected thereto.

Against this background, there still remains room for improvement in terms of construction of such eyebolts.

SUMMARY OF THE INVENTION

The invention is therefore based on the object to improve an eyebolt of the afore-stated type such that despite a clearance-free connection of its individual parts a smallest possible structural height is provide while still exhibiting great load-bearing capacity.

The object is attained according to the invention by an eyebolt for the releasable connection of a carrying, lashing or traction member to an object, which includes both a threaded bolt and an eyelet. The eyelet is hereby connected to an outer bearing part whereas the threaded bolt has a corresponding inner bearing part. The outer bearing part is supported on the inner bearing part through interposition of rolling bodies. The rolling bodies are hereby arranged in a ring around the inner bearing part such that they move above one another in at least two planes that are parallel to each other at a predefined distance. The rolling bodies disposed in a first plane and the rolling bodies disposed in a second plane have a same radius within their respective planes.

In the accordance with invention, the sum of the radius of one of the rolling bodies disposed in the first plane and the radius of one of the rolling bodies disposed in the second plane is greater than the distance between the two planes in which the individual rolling bodies are arranged.

The particular advantage lies in a combination of the advantages of two ring planes arranged above one another and, at the same time, having little structural height. The rolling bodies, in turn, are at least rotationally symmetric about a rotation axis. The radius is hereby established between the rotation axis and the outer surface of the respective rolling body. In particular, when a spherical rolling body is involved, the respective radius is established from the distance of the outer surface of the rolling body to its center. The arrangement of the rolling bodies in the respective planes is selected within the scope of the invention such that either their center or a physical end of their rotation axis lies in one of the planes. Of course, the respective rotation axis can also run parallel and thus lie within one of the planes.

As the distance of the planes is smaller than the sum of the radii established by the superimposed arrangement of the rolling bodies, the individual rolling bodies have to interlock in at least some areas and thereby overlap the planes. In other words, a rolling body of one plane dips in some areas between two rolling bodies of the other plane so as to establish between the outer surfaces of the rolling bodies an imaginary meandering separation path which extends in a the shape of a ring between the two levels about the inner bearing part.

As a result of this arrangement, the ring tracks defined by the rolling bodies arranged in the individual planes can be arranged within one another as to have a continuous overlap about the inner bearing part. In this way, the height, required when using two ring tracks, is reduced by engaging the rolling body alternatingly between two respective rolling bodies of the other plane.

In an advantageous manner, two rolling bodies arranged immediately behind one another in the same plane have a point contact with at least one of the rolling bodies in the respective other plane. A point contact between individual rolling bodies becomes possible when at least some of the rolling bodies are configured in the form of a ball.

As a result of the point contact between the rolling bodies arranged separately from one other in the planes, a force-transmitting brace can form there between, having a positive effective on the clearance-free support of the outer bearing part on the inner bearing part. In other words, there is no need for a respective tilting of the outer bearing part on the inner bearing part to provide a force-transmitting contact between the rolling bodies.

In an alternative embodiment, provision is made for a line contact between two rolling bodies arranged immediately one behind the other in the same plane with at least one of the rolling bodies from the other plane. As a result, none of the rolling bodies having this contact with each other can have the shape of a ball, but rather has to have a cylindrical shape. A respective line contact is established between the outer surface areas of the rolling bodies that contact one another. The advantage provided thereby is that, compared to the point contact, the line contact produces a larger contact length for forces. As a result, the force to be transmitted is transmitted onto a larger area so that the reduced stress between the rolling bodies enable a smoother rolling thereof, when the outer bearing part rotates relative to the inner bearing part.

Preferably, any three rolling bodies define an angle of 60° to <180° between them. Two of the respective rolling bodies are hereby jointly arranged in one plane whereas the remaining rolling body lies in the respective other plane. In this constellation, the centers and/or rotation axes of the individual rolling bodies form a closed triangle. The definition of the angle is based on the fact that two rolling bodies arranged in the same plane support or rest on the remaining rolling body lying in the other plane. The involved angle is thus defined by the imaginary connections between the individual rolling body and the other two rolling bodies that are arranged in the same plane.

So long as all rolling bodies have the same radius, the three rolling bodies are, as described above, in contact with each other, when the angle is 60°. The greater the selected angle, the further the separation of rolling bodies arranged next to one another in the same plane. As a result of the separation of the rolling bodies, which are arranged sometimes below one another or opposite the rolling body resting there above, their rotation movement may be facilitated, because at least a contact there between that slows down their rotation movement is only slight or substantially eliminated.

Of course, the afore-defined position of the angle between the three rolling bodies may also be implemented in such a way that the angle is established between the imaginary connections of two rolling bodies arranged in the same plane and of one of these rolling bodies in relation to the rolling body in the other plane. Also in this case, the contact of the rolling bodies amongst one another would be eliminated at an angle of >60° to <180°, i.e. between the individual rolling body and one of the two rolling bodies lying in the same plane.

Depending on the demand and desired structural height, the angle between the individual rolling bodies angle can be up to <180° so that the respectively individual rolling body dips as far as possible between the rolling bodies of the other plane. Basically, at least one of the rolling bodies arranged in a plane remains in touching contact with one rolling body arranged in the other plane. This ensures that any occurring forces are transmitted directly by the forming brace via the two planes through the rolling bodies. The involved brace extends hereby at an angle to the longitudinal direction of the inner bearing part as a result of the arrangement of the rolling bodies relative to one another.

Parallel to the two planes, are flanks that bound them upwards and downwards. These flanks enable formation of a channel which is arranged about the inner bearing part and within which the individual rolling bodies are arranged in their respective planes. The circumference of the channel as well as the radius and number of the individual rolling bodies ensures that the rolling bodies arranged in the same plane cannot leave them. As a result of the juxtaposition of the individual rolling bodies in each plane, there is no gap large enough for a rolling body from the first plane to change to the second plane, and vice versa.

Preferably a roller groove, rounded in cross section, is arranged in the individual planes. Consequently, each of the planes runs through one of the ring-shaped roller grooves. The respective apex of the rounded roller groove runs effectively in one of the planes. The roller grooves can hereby be arranged in the outer bearing part. As an alternative, the roller grooves can also be arranged in the inner bearing part. Preferably, the roller grooves are arranged both in the outer bearing part and in the outer bearing part. In that way, a greatest possible guidance of the individual rolling bodies is rendered possible. Thus, the respective rolling bodies run in the individual plane while being enclosed by the respective roller grooves so that each one of the individual rolling bodies is afforded a greatest possible support within the eyebolt.

Depending on the configuration, at least one of the roller grooves can also have a polygonal contour in cross section. Furthermore, this polygonal roller grooves can also possess rounded transitions between their bottom and the walls that bound them to the sides.

Provision is made for the roller grooves arranged in the outer bearing part to merge into one another to thereby form a bridge between the planes. Of course, the roller grooves can also be arranged in the inner bearing part and merge into one another to thereby form a bridge between the planes. In particular, when arranging the roller grooves both in the outer bearing part and in the inner bearing part, the roller grooves can merge into one another on at least one of these parts to thereby form a bridge between the planes.

In particular the depth of the respective roller groove plays a role in this configuration. The less depth the roller grooves in the outer bearing part and/or the inner bearing part have, that wider is the bridge between the two roller grooves. As the depth of the roller grooves increases, the bridge gets narrower and forms ultimately a sharp edge when reaching a common intersection point of the rounded roller grooves in the plane of the outer surface of the outer bearing part and/or the inner bearing part. The formation of the bridge defines a clear boundary of the roller grooves arranged for the determination of the position of the roller bodies and thus for the raceway of the rolling bodies.

Depending on the depth and configuration of the roller grooves, provision is made for the bridge to spring back relative to an inner surface of the outer bearing part. So long as the roller grooves are arranged in the inner bearing part, the bridge arranged there between may also spring back in relation to an outer surface of the inner bearing part also spring back. Of course, the bridge can also spring back relative to an inner surface of the outer bearing part and an outer surface of the inner bearing part, so long as the roller grooves are arranged in both the inner bearing part and the outer bearing part.

The advantage in the spring back of the bridge is based on the recognition that the roller grooves can have a greatest possible depth for guiding the rolling bodies. Only by the springing back of the bridge can the individual rolling bodies overlap the planes and penetrate into the ring track of the other ring-shaped rolling body so as to establish a meandering separation path between the rolling bodies running in the individual roller grooves. Moreover, the springing back of the bridge results in a reduced height so that the latter is able to absorb greater loads transversely to its extent parallel to the two planes, because of the shorter lever arm.

The inner bearing part has a height that extends in its longitudinal direction. As pointed out before, the inner bearing part including the rolling bodies are embraced about the circumference by the outer bearing part. Preferably, the maximal height of the inner bearing part corresponds to a height of the outer bearing part which height also extends in the longitudinal direction of the inner bearing part. Consequently, the height of the outer bearing part corresponds to the maximum height of the inner bearing part. Preferably, the outer bearing part has a shorter height than the inner bearing part. As a result of thus narrower ring-shaped configuration of the outer bearing part in relation to the inner bearing part, the jam-free rotatability of the outer bearing part is rendered possible also when the eyebolt is arranged on an object. In this way, it is assured that the eyebolt coupled with an object via the threaded bolt has a gap between the outer bearing part and the region where the object is received within the threaded bolt. Furthermore, as a result the inner bearing part is not unnecessarily embraced by outer bearing part at its head side facing the threaded bolt so that the structural height of the eyebolt is overall reduced.

Since the outer bearing part does not extend in the shape of a hat over inner bearing part, respective sealing measures can be provided between the inner bearing part and the outer bearing part so as to effectively prevent foreign matters as well as liquid media from penetrating into the gap between the inner bearing part and the outer bearing part.

Furthermore, the outer bearing part has a conical outer surface. Preferably, the outer bearing part has a primarily rotationally symmetric outer surface which is inclined all-round in relation to the longitudinal direction of the inner bearing part. Because of the conical shape, the wall thicknesses of the outer bearing part can be suited to the applied loads. Thus, the outer bearing part can preferably have a cross section which tapers toward the threaded bolt, whereas its outer surface increases radially toward the eyelet arranged on the outer bearing part. In particular, the thickened regions of the outer bearing part toward the eyelet provide the reliable force introduction via the eyelet into the eyebolt and thus into its outer bearing part.

Furthermore, the conical shape of the outer bearing part, which preferably tapers toward the threaded bolt, has the advantage that the eyebolt smallest possible dimensions in relation to the outer bearing part in the area of its attachment to an object. Thus, the eyebolt can be easily mounted to the respective object, even when the space conditions are tight.

According to an advantageous configuration, the threaded bolt of the eyebolt is made in one piece with the inner bearing part. The single-piece construction enables in addition to the simple manufacture a reliable and even force transfer between the inner bearing part and the outer bearing part. Depending on the configuration, standardized sizes can be used for a threaded bolt having a head that needs to be machined only for receiving the rolling bodies.

Furthermore, it provision is made for the inner bearing part to have a tool engagement contour on one end face distal to the threaded bolt. In this way, the eyebolt can be screwed onto or into the inner bearing part in the region of the eyelet to the respective object by the application of a tool. Preferably, the tool engagement contour is designed with a contour which is directed into the inner bearing part for receiving an Allen wrench for example. Of course, the inner bearing part may also have a tool engagement contour in the form of an external hexagonal head.

With a view to a smallest possible structural height of the eyebolt, the tool engagement contour directed into the inner bearing part is preferably a hexagonal socket. Conversely, in particular when an eyelet that swings in relation to the outer bearing part is involved, a tool engagement contour may also be arranged in the form of a slot or cross and directed into the inner bearing part for use of a respective screwdriver.

Furthermore, the eyelet can be formed in one piece with the outer bearing part. Compared to an eyelet arranged hingedly on the outer bearing part, the advantage lies here first in a simpler manufacture. Furthermore, as it is fixed as a result of the single-piece configuration in relation to the outer bearing part, the eyelet, even when the eyebolt assumes a perpendicular arrangement, is clearly aligned in relation to the longitudinal direction of the inner bearing part so that an unwanted bending of the eyelet is prevented, for example, when a oblique load is applied.

The outer bearing part can have at least two closeable accesses. The accesses are provided for insertion of the rolling bodies, arranged between the inner bearing part and the outer bearing part, when manufacturing the eyebolt. Depending on the configuration, the outer bearing part can, of course, have only one individual closable access. At least two closeable accesses in the outer bearing part are preferable, which are arranged in area of the planes of the rolling bodies, respectively.

In each case, the respective access should communicate with one of the roller grooves. For this purpose, the respective access in the outer bearing part is oriented such that a rolling body, inserted via the access, can be directly placed into the intended roller groove. Thus, the accesses can also be tilted in relation to the longitudinal direction of the inner bearing part, while also communicating with the roller grooves and directed toward them. Moreover, the accesses serve to remove, if need be, individual rolling bodies from their position, for example for their replacement. Furthermore, the accesses serve to provide both the rolling bodies with a suitable sliding agent. Thus, for example, grease or other lubricant may be introduced via at least one of the accesses.

To enable the arrangement of the rolling bodies in accordance with the invention, it is provided that the number of rolling bodies in the respective planes is identical. In view of the identical number of the rolling bodies, the arrangement in accordance with the invention is achieved by placing them at an offset relative to each other in relation to the planes and to thereby alternatingly engage into the ring track of the other plane between the rolling bodies provided there.

Of course, the number of rolling bodies with respect to the individual planes can also differ from each other, however, they then have different dimensions, in particular radii. For example, the rolling bodies in the first plane can have a greater radius than the rolling bodies in the second plane so that the rolling bodies in the first plane contact at least two rolling bodies in the second plane. This results in force dissipation via a large rolling body in the first plane onto two smaller rolling bodies arranged in the second plane.

Provision is made within the scope of the invention for the rolling bodies arranged in the planes to be aligned above one another parallel or at an angle to a longitudinal direction of the inner bearing part. Therefore, the rolling bodies arranged above one another in the two planes in a cross section of the eyebolt can be arranged directly above one another or offset to one another with respect to an imaginary connection line that connects them.

In the first case, the imaginary connection line runs parallel to the longitudinal direction, whereas in the second case, the connection line defines an angle between it and the longitudinal direction of the inner bearing part.

In this embodiment, the rolling bodies of the first plane and the rolling bodies of the second plane have preferably radii that are different from each other. Despite a same number of rolling bodies in the respective planes, a ring track of rolling bodies arranged behind one another in one of the planes forms a circumference which differs from the other ring track in the other plane. In view of the different circumferences in the individual planes of the rolling bodies as a result of the varying radii in the individual planes of the rolling bodies, the rolling body of one of the ring tracks spring back in relation to the respectively other ring track. In this case, in particular the rolling bodies spring back in the plane in relation to the rolling bodies in the other plane, which have a small radius. The reason for that is a smaller circumference of the successively arranged rolling body.

As a result of the incline of the rolling bodies, the force pattern between the individual rolling bodies in the different planes can be optimized. In this way, the oblique brace forming necessarily between the planes of the offset rolling bodies can be further inclined in relation to the longitudinal direction of the inner bearing part.

Preferably, the rolling bodies have a spherical configuration. As an alternative embodiment, the rolling bodies may also be configured as cylinder. According to a further variant, it is provided that the rolling bodies can be configured as truncated cone.

The configuration of the rolling bodies as balls has the advantage of a simplest possible construction and very easy arrangement of the rolling bodies between the inner bearing part and the outer bearing part. Conversely, a rolling body in the form of a cylinder or a truncated cone has, compared to a ball, a greater contact zone that can be used for force transmission.

In the event, spherical rolling bodies are inadequate for force transmission, it has been viewed as especially advantageous to form the rolling bodies in the shape of a truncated cone. The tapering ends of the rolling bodies point to the longitudinal direction of the inner bearing part, whereas their thicker ends point radially away from the longitudinal direction. In this context, the rolling bodies in the form of truncated cones in the first plane and the second plane can have a variable orientation from one another. Thus, the truncated-cone shaped rolling bodies in the first plane can, for example, point with their tapered ends toward the longitudinal direction of the inner bearing part, whereas the rolling bodies in the second plane are aligned with their thickened ends in the same direction.

Preferably, the rolling bodies in both ring track planes have identical dimension. This applies in particular against the background of a most economical manufacture of the rolling bodies as well as their simple and quick arrangement within the eyebolt.

The invention provides a very advantageous configuration of an eyebolt having an eyelet that is rotatable in relation to the threaded bolt. In particular, the arrangement of the individual rolling bodies in two spaced-apart planes, with the planes of the rolling bodies overlapping into the ring track of the respectively other one, enables a smallest possible overall structural height for the eyebolt, despite the possibility to transmit high forces. Moreover, the arrangement of the rolling bodies in accordance with the invention provides that the eyelet with the outer bearing part is able to easily rotate in unloaded state in relation to the inner bearing part that is attached to an object via the threaded bolt. Conversely, a traction force, particularly in the longitudinal direction of the inner bearing part, causes increased pressure between the rolling bodies in the individual planes which rolling bodies are braced amongst each other as a result of the rotational direction which in some instances is in opposition to one another. In this way, the eyelet is prevented or at least impeded from inadvertently rotating when under stress.

BRIEF DESCRIPTION OF THE DRAWING

The invention will be explained in greater detail with reference to exemplary embodiments schematically shown in the drawings. It is shown in.

DETAILED DESCRIPTION OF PREFERRED EMBODIMENTS

Figure 1:
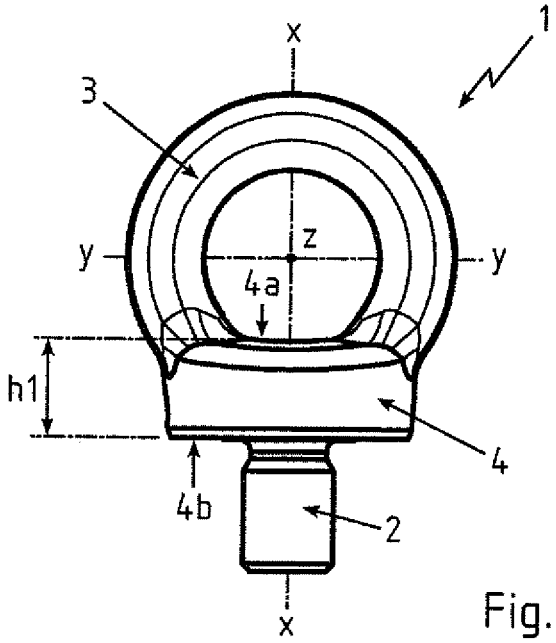
FIG. 1 a first elevation of an eyebolt in accordance with the present invention.

FIG. 1 shows an eyebolt 1 in accordance with the invention. The eyebolt 1 is provided to releasably connect a not shown carrying, lashing or traction member with an object, also not shown. The eyebolt 1 includes a threaded bolt 2, shown simplified, and an eyelet 3. The eyelet 3 is connected by an outer bearing part 4 to the threaded bolt 2.

The threaded bolt 2 is arranged on a side of the outer bearing part 4 that is opposite to the eyelet 3. The threaded bolt 2 extends hereby in a longitudinal direction x, whereas the eyelet 3 extends in a plane defined by the longitudinal direction x and a transverse direction y extending perpendicular thereto. The eyelet 3 extends in the shape of a ring about a second transverse direction z which also extends perpendicular to the longitudinal direction x and the first perpendicular transverse direction y. The ring-shaped eyelet 3 is formed as three-quarter circle, with its respective ends being affixed to the outer bearing part 4. The eyelet 3 forms here a single-piece component with the outer bearing part 4.

Further, the outer bearing part 4 has a height h1 which extends between a topside 4*a* and a bottom side 4*b* which extends in the longitudinal direction x and parallel thereto at a distance.

Figure 2:
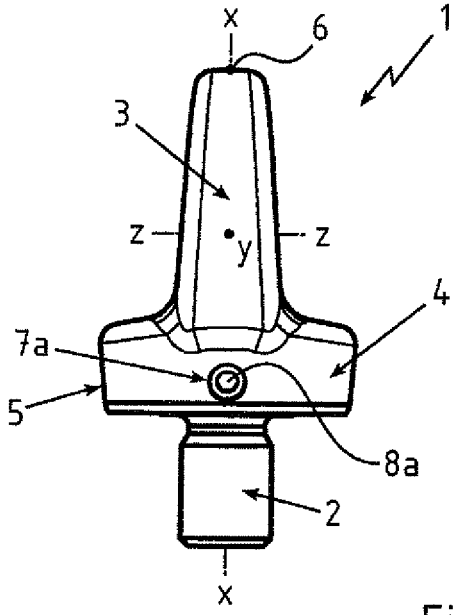
FIG. 2 a side view of the eyebolt of FIG. 1.

FIG. 2 depicts more clearly a view of the eyebolt 1 of FIG. 1 rotated by 90° about the longitudinal direction x. This view clearly shows that the thickness of the eyelet 3 in the second transverse direction z is less than the width of the outer bearing part 4, as measured also parallel to the second transverse direction z. The outer bearing part 4 has a conical outer surface 5. The outer surface 5 of the outer bearing part 4 is inclined relative to the longitudinal direction x, with the outer bearing part 4 tapering towards its side facing the threaded bolt 2. Conversely, the outer bearing part 4 widens toward the side that confronts the threaded bolt 2 and thus faces the eyelet 3.

In this view, the eyelet 3 also has a conical profile with its greatest expanse in relation to its thickness lying in the region of the outer bearing part 4, while the eyelet 3 tapers toward its apex 6.

In a region of the outer surface 5 of the outer bearing part 4 between the eyelet 3 and the threaded bolt 2, the outer bearing part has an access 7*a* which extends through a part of the outer bearing part 4 in a manner not shown herein. The access 7*a* is closed by a threaded pin 8*a* which has a tool engagement surface in the form of a hexagon socket. Thus, a tool in the form of an Allen wrench, not shown in greater detail, can remove the threaded pin 8*a* from the access 7*a*.

Figure 3:
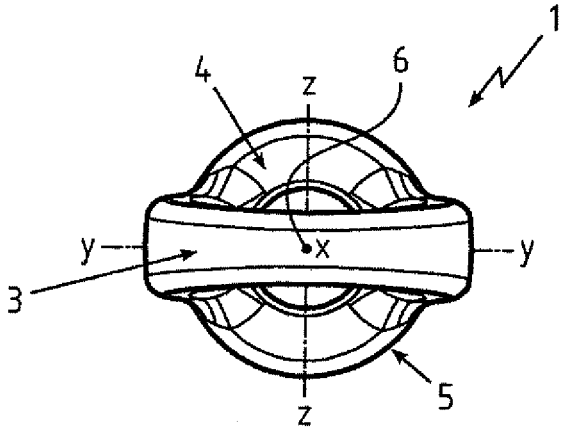
FIG. 3 a plan view of the eyebolt of FIGS. 1 and 2.

FIG. 3 is a plan view of the eyebolt 1, as viewed in longitudinal direction x, and clearly shows the configuration of the eyelet 3 and the outer bearing part 4. As already shown in FIG. 2, the thickness of the eyelet tapers toward its apex 6. The outer bearing part 4 has a round shape so that its outer surface 5 extends about the longitudinal direction x in a circle.

Figure 4:
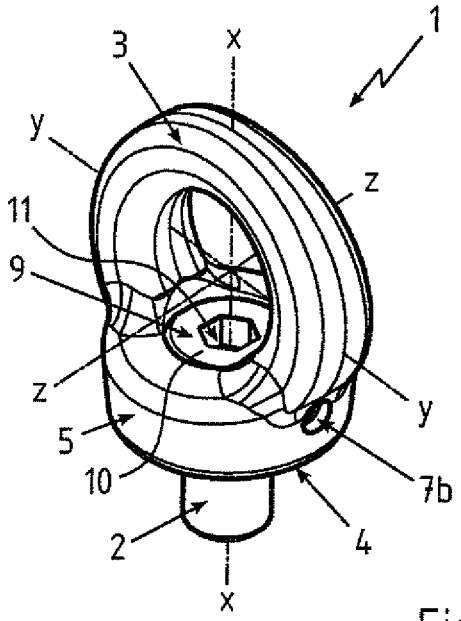
FIG. 4 a perspective illustration of the eyebolt of FIGS. 1 through 3.

FIG. 4 shows again the features of the eyebolt 1 as explained in the foregoing FIGS. 1 through 3 by way of a perspective view. As can be seen, the longitudinal direction x intersects jointly with the first transverse direction y and the second transverse direction z in the eye of the ring-shaped eyelet 3. This illustration further clears the view onto an end face 9 of the inner bearing part 10, which is embraced by the outer bearing part 4 in the shape of a ring. The inner bearing part 10 has hereby a tool engagement contour 11 on its end face 9 distal to the threaded bolt 2. As already shown with the threaded pin 8*a* in FIG. 2, the tool engagement contour 11 in the end face 9 of the inner bearing part 10 is also configured as hexagon socket.

Another access 7*b* can be seen in this illustration and is disposed opposite to the access 7*a* of FIG. 2 that is not shown here. The access 7*b* is shifted in its position in the outer bearing part 4 to the transition zone between the eyelet 3 and the outer bearing part 4

Figure 5:
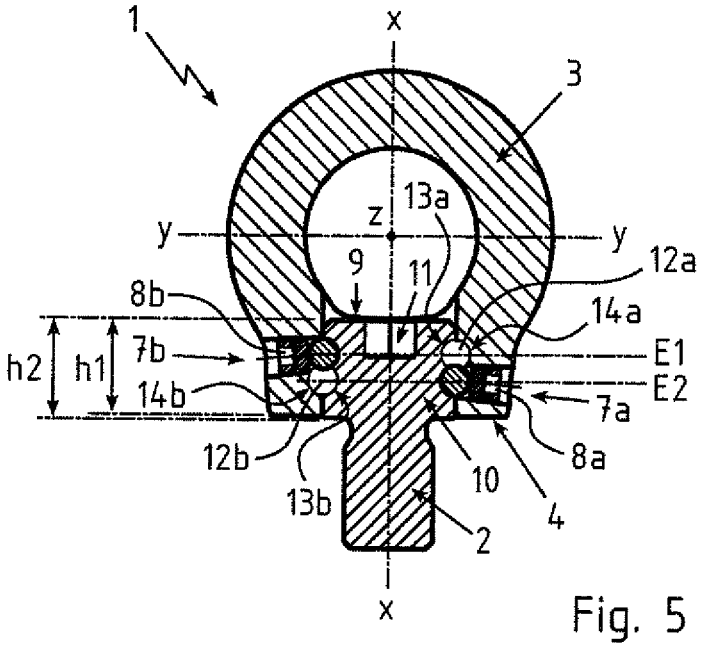
FIG. 5 a sectional illustration of the eyebolt of FIG. 1.

FIG. 5 elucidates the inner structure of the eyebolt 1 by way of a sectional view. The section is taken in the plane which is defined by the longitudinal direction x and the first transverse direction y and in which the eyelet 3 extends. The section clearly shows that the threaded bolt 2 is formed in one piece with the inner bearing part 10. Furthermore, it is again made clear that the eyelet 3 is formed in one piece with the outer bearing part 4. As can be seen next to the tool engagement contour 11, also by sectional view, in the end face 9 of the inner bearing part 10, the outer bearing part 4 is supported on the inner bearing part 10 through interposition of rolling bodies 12*a*, 12*b*. The rolling bodies 12*a*, 12*b* are respectively disposed around the inner bearing part 10 in one of two planes E1, E2 in spaced-apart relationship to the longitudinal direction and in parallel relation.

The section clearly shows that the two accesses 7*a*, 7*b*, lie opposite to each other and are respectively closed by threaded pins 8*a*, 8*b*. The accesses 7*a*, 7*b* are oriented towards the rolling bodies 12*a*, 12*b*, of a respective one of the planes E1, E2. By removing at least one of the threaded pins 8*a*, 8*b*, it is possible to remove and also insert the rolling bodies 12*a*, 12*b*. Roller grooves 13*a*, 13*b*, 14*a*, 14*b*, are provided in the outer bearing part 4 and the inner bearing part 10 to receive the rolling bodies 12*a*, 12*b*. The roller grooves 13*a*, 13*b*, 14*a*, 14*b* have a rounded cross section, with the accesses 7*a*, 7*b*, communicating with the respective roller grooves 13*a*, 13*b*, 14*a*, 14*b*. The roller grooves 13*a*, 13*b*, 14*a*, 14*b*, are respectively arranged in one of the two planes E1, E2. In this way, the roller groove 13*a* of the inner bearing part 10 and the roller groove 14*a* of the outer bearing part 4 lie opposite each other in the first plane E1, while the other roller groove 13*b* of the inner bearing part 10 and the roller groove 14*b* of the outer bearing part 4 lie opposite each other on the second plane E2. The roller grooves 13*a*, 13*b*, 14*a*, 14*b* embrace the rolling bodies 12*a*, 12*b*, at least in some areas, so that the outer bearing part 4 is supported on the inner bearing part 10 by the rolling bodies 12*a*, 12*b*.

Both the inner bearing part 10 and the outer bearing part 4 have a height h1, h2, extending in the longitudinal direction x of the inner bearing part 10. The height h2 of the inner bearing part 10 extends between the threaded bolt 2 and the end face 9 of the inner bearing part 10. The height h2 of the inner bearing part 10 extending in longitudinal direction x of the inner bearing part 10 is hereby smaller than the height h1 of the outer bearing part 4 that also extends in longitudinal direction x and embraces the inner bearing part 10.

As can be seen, the rolling bodies 12*a*, 12*b* disposed in the individual planes E1, E2, are arranged such that they overlap, at least in some areas, with their respective projection surfaces. With reference to the illustration of FIG. 5, the present section plane is defined such that a respective one of the rolling bodies 12*a*, 12*b* is shown by a section view in its greatest cross section. This elucidates that the respective immediately adjacent rolling body 12*a*, 12*b* in the respective other plane E1, E2 has an overlap with the sectioned rolling body 12*a*, 12*b*.

Figure 6:
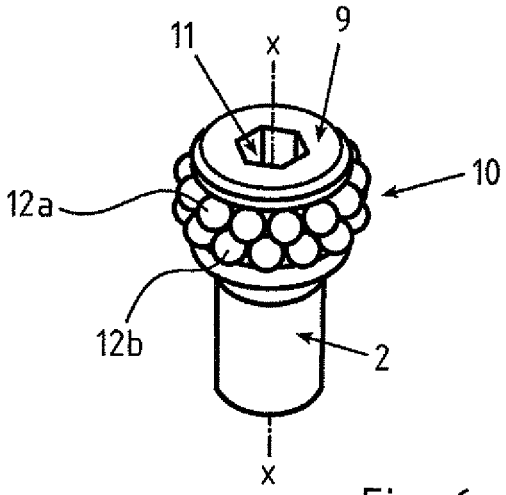
FIG. 6 a perspective illustration of a separated bearing part of the eyebolt of FIGS. 1 through 5.

FIG. 6 shows a perspective illustration of the threaded bolt 2 together with the inner bearing part 10 outside of the eyebolt 1 that is not shown further. As can be seen, the individual rolling bodies 12*a*, 12*b* are respectively configured as bails, which are arranged in the shape of a ring around the inner bearing part 10 above one another This view clearly shows that the individual rolling bodies 12*a*, 12*b* are offset to one another so as to establish a point contact between the individual rolling bodies 12*a*, 12*b*.

FIG. 7 shows again a detailed illustration of the construction of the threaded bolt 2 with the inner bearing part 10 formed therewith in one piece, as well as the rolling bodies 12*a*, 12*b* surrounding the latter. This view again clearly shows that an externally threaded bolt 2 is constructed in one piece with the inner bearing part 10.

Figure 7:
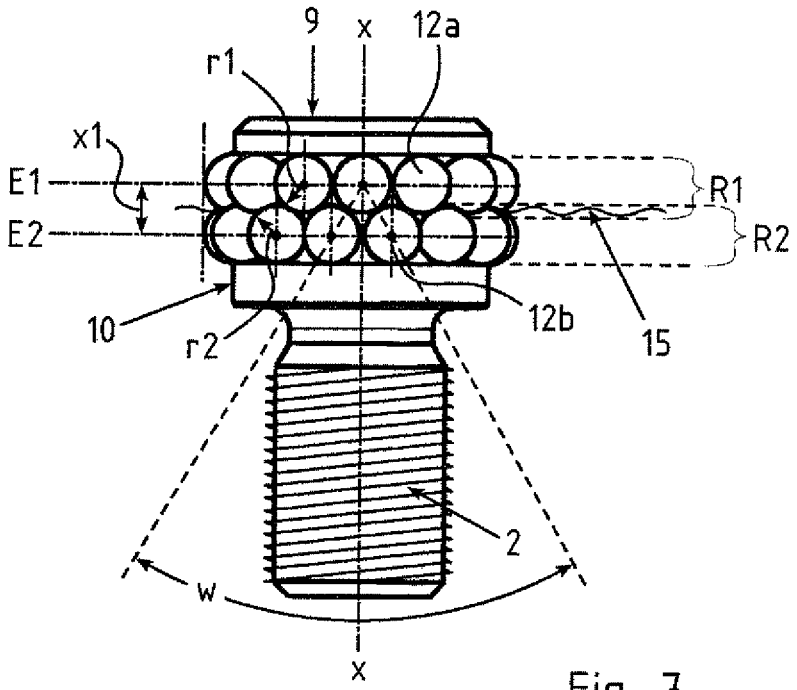
FIG. 7 an elevation of the bearing part of FIG. 6.

With reference to the illustration of FIG. 7, the upper rolling bodies 12*a* are arranged around the inner bearing part 10 in the form of a ring track R1, whereas the lower rolling bodies 12*b* also run in a ring track R2 around the inner bearing part 10. The width of the respective ring tracks R1, R2 in longitudinal direction x is established by the respective outer dimensions of the individual rolling bodies 12*a*, 12*b*.

Both the upper rolling bodies 12*a* and the lower rolling bodies 12*b* have each a radius r1, r2, which is identical here. Moreover, the two planes E1, E2, within which the rolling bodies 12*a*, 12*b* are arranged, are spaced from each other. The two planes E1, E2, run hereby parallel to one another at a distance x1. The arrangement of the individual rolling bodies 12*a*, 12*b* is selected such that the ring tracks R1, R2 have there between an overlap within which an imaginary meandering separation path 15 is formed between the individual rolling bodies 12*a*, 12*b*.

The meandering shape of the separation path 15 is based on the engagement of individual rolling body 12*a*, 12*b*, of one plane E1, E2 between two rolling bodies 12*a*, 12*b*, the respectively other plane E1, E2. With reference to the longitudinal direction x, the individual rolling bodies 12*a*, 12*b* are not directly stacked on one another in the planes E1, E2, but rather are inclined relative to one another. As a result, the sum of the radius r1 of one rolling body 12*a* arranged in the first plane E1 and the radius r2 of one rolling body 12*b* arranged the second plane E2 is greater than the distance x1.

Therefore, two rolling bodies 12*a*, 12*b* arranged immediately behind one another in the same plane E1, E2 establish a point contact with at least one of the rolling bodies 12*a*, 12*b* of the other plane E1, E2. Any three rolling bodies 12*a*, 12*b* define hereby an angle w of 60° there between. For this purpose, two of these rolling bodies 12*b* are arranged together in one of the planes E2, while the remaining rolling body 12*a* lies in the respective other plane E1. Furthermore, although not shown in greater detail, it is regarded as advantageous that the number of the rolling bodies 12*a*, 12*b*, in the individual planes is identical.

Basically, the rolling bodies 12*a*, 12*b*, can also be arranged with clearance relative to each other, so that not all rolling bodies 12*a*, 12*b*, have a point contact with one another. This clearance can be within the ring tracks R1, R2 and/or between the ring tracks R1, R2. In this case, three of the rolling bodies 12*a*, 12*b* can define an angle w there between which deviates from 60°. In summary, at least some of the rolling bodies 12*a*, 12*b* can have a continuous point contact or at least a temporary point contact amongst each other, depending on the state of position within the eyebolt during operation or at standstill.

As can be seen, the rolling bodies 12*a*, 12*b* in both planes E1, E2 are identical, especially in terms of dimensions. Even though one of the ring tracks R1, R2, can have a small circumference in a manner not shown here, the rolling bodies 12*a*, 12*b* arranged in the planes E1, E2 are oriented above one another in parallel relation to the longitudinal direction x of the inner bearing part 10.

Figure 8:
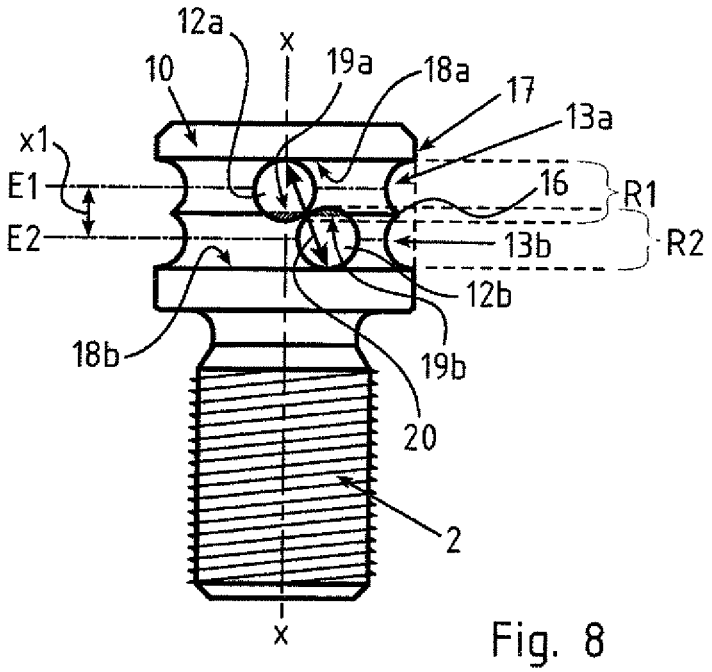
FIG. 8 an elevation of the bearing part of FIGS. 6 and 7 in released form.

FIG. 8 shows the regions of the eyebolt 1 in the form of the threaded bolt 2 and the inner bearing part 10 as single-piece component. For ease of illustration of the arrangement of the rolling bodies 12*a*, 12*b*, merely two of these rolling bodies are schematically shown. Omitting the remaining rolling bodies enables a look at the circumferential roller grooves 13*a*, 13*b* which extend around the inner bearing part 10. The roller grooves 13*a*, 13*b*, arranged on the inner bearing part 10, merge into each other and form a bridge 16 between the roller grooves 13*a*, 13*b*, The bridge 16 springs back in relation to an end face 17 of the inner bearing part 10. As a result, the thickest part of individual rolling bodies 12*a*, 12*b* is not guided on both sides in the ring tracks R1, R2. In other words, the rolling bodies 12*a*, 12*b* arranged in both planes E1, E2, are guided only in the region of their thickest part by the flanks 18*a*, 18*b* on their opposing outer sides, while the respective opposing sides of the rolling bodies 12*a*, 12*b* project beyond the plane of the bridge 16. As a result, a region 19*a*, 19*b* of the rolling body 12*a*, 12*b* exits the respective ring track R1, R2 and projects beyond the bridge 16 into the respective opposing ring track R1, R2. As a result, the thus inevitably staggered arrangement of the individual rolling bodies 12*a*, 12*b* relative to one another enables formation of a diagonal brace 20 between the rolling bodies, 12*a*, 12*b* with reference to the longitudinal direction x.

The invention claimed is:

1. An eyebolt for releasably connecting a carrying, lashing or traction member with an object, comprising:

a threaded bolt having an inner bearing part;

an eyelet connected to an outer bearing part; and rolling bodies configured to support the outer bearing part on the inner bearing part, said rolling bodies being arranged in the shape of a ring about the inner bearing part above one another in at least two planes which are spaced from one another by a distance and extend in parallel relation, with a first plurality of the rolling bodies arranged in one of the planes having a radius, and with a second plurality of the rolling bodies arranged in an another one of the planes having a radius, wherein a sum of the radius of one of the rolling bodies arranged in the one plane and the radius of one of the rolling bodies arranged in the other plane is greater than the distance.

2. The eyebolt of claim 1, wherein any two rolling bodies arranged immediately behind one another in one of the planes have a point contact with at least one of the rolling bodies in the other one of the planes.

3. The eyebolt of claim 1, wherein any three rolling bodies define an angle of 60° to less than 180° there between, with two of these rolling bodies being arranged jointly in one of the planes while the remaining rolling body lies in the other one of the planes.

4. The eyebolt of claim 1, wherein at least one of the outer bearing part and the inner bearing part has a roller groove arranged in each of the planes and having a rounded cross section.

5. The eyebolt of claim 4, wherein the roller groove in one of the planes and the roller groove in the other one of the planes merge into each other and form a bridge between the planes.

6. The eyebolt of claim 5, wherein the bridge extends inwards in relation to an inner surface of the outer bearing part or an end face of the inner bearing part.

7. The eyebolt of claim 4, wherein the outer bearing part has two closeable accesses which are respectively arranged in an area of the planes and communicate with the roller grooves.

8. The eyebolt of claim 1, wherein the inner bearing part is defined by a height extending in a longitudinal direction of the inner bearing part, and the outer bearing part is defined by a height extending in the longitudinal direction and embracing the inner bearing part, said height of the inner bearing part corresponding at a maximum to the height of the outer bearing part.

9. The eyebolt of claim 1, wherein the outer bearing part has a conical outer surface.

10. The eyebolt of claim 1, wherein the threaded bolt is formed in one piece with the inner bearing part.

11. The eyebolt of claim 1, wherein the inner bearing part has a tool engagement contour at an end face distal to the threaded bolt.

12. The eyebolt of claim 1, wherein the eyelet is formed in one piece with the outer bearing part.

13. The eyebolt of claim 1, wherein the first and second pluralities of the rolling bodies in the planes are identical.

14. The eyebolt of claim 1, wherein the first and second pluralities of the rolling bodies arranged in the planes are oriented above one another in parallel relation or at an angle in relation to a longitudinal direction of the inner bearing part.

15. The eyebolt of claim 1, wherein the rolling bodies are formed as ball.

16. The eyebolt of claim 1, wherein the first and second pluralities of the rolling bodies arranged in the planes have identical dimensions.

* * * * *